US011655967B2

(12) United States Patent
Rao et al.

(10) Patent No.: US 11,655,967 B2
(45) Date of Patent: May 23, 2023

(54) LED HIGH BAY LAMP WITH TOOLLESS LED DRIVER CONNECTION

(71) Applicant: Litetronics International, Inc., Bedford Park, IL (US)

(72) Inventors: Raghu Rao, Romeoville, IL (US); Robert Sorensen, Bedford Park, IL (US)

(73) Assignee: Litetronics International, Inc., Bedford Park, IL (US)

( * ) Notice: Subject to any disclaimer, the term of this patent is extended or adjusted under 35 U.S.C. 154(b) by 0 days.

(21) Appl. No.: 17/493,825

(22) Filed: Oct. 4, 2021

(65) Prior Publication Data

US 2023/0107721 A1 Apr. 6, 2023

(51) Int. Cl.

| | |
|---|---|
| ***F21V 21/008*** | (2006.01) |
| ***F21V 17/00*** | (2006.01) |
| ***F21V 23/00*** | (2015.01) |
| ***F21V 17/10*** | (2006.01) |
| ***F21V 17/18*** | (2006.01) |
| ***F21V 23/06*** | (2006.01) |
| *F21V 29/77* | (2015.01) |
| *F21Y 115/10* | (2016.01) |

(52) U.S. Cl.

CPC ..... *F21V 17/002* (2013.01); *F21V 17/107* (2013.01); *F21V 17/18* (2013.01); *F21V 23/008* (2013.01); *F21V 23/06* (2013.01); *F21V 21/008* (2013.01); *F21V 29/773* (2015.01); *F21Y 2115/10* (2016.08)

(58) Field of Classification Search

CPC ..... F21V 23/008; F21V 23/06; F21V 21/008; F21V 17/002; F21V 17/107; F21V 17/18

See application file for complete search history.

(56) References Cited

U.S. PATENT DOCUMENTS

| | | | | |
|---|---|---|---|---|
| 4,403,277 | A * | 9/1983 | Eargle, Jr. | F21V 23/02 174/50 |
| 5,528,473 | A * | 6/1996 | Kassay | F21S 8/04 362/216 |
| 7,524,083 | B2 * | 4/2009 | Sandoval | F21V 23/026 362/147 |
| 8,235,555 | B2 * | 8/2012 | Thomas | F21V 23/026 362/294 |
| 8,692,444 | B2 * | 4/2014 | Patel | F21V 29/83 313/46 |
| 9,423,110 | B1 * | 8/2016 | Newton | F21V 29/773 |
| 10,215,371 | B1 * | 2/2019 | Lehman | F21V 17/20 |
| 10,641,477 | B2 * | 5/2020 | Jenson | F21V 15/01 |
| 11,149,912 | B2 * | 10/2021 | Rao | H05B 45/30 |

(Continued)

*Primary Examiner* — Ismael Negron

(74) *Attorney, Agent, or Firm* — Witters & Assoicates; Steve Witters

(57) ABSTRACT

An LED high bay includes a housing, a hand-separable connector, and an LED driver disposed within the housing. The housing includes a first housing portion, a second housing portion hingedly attached to the first housing portion, and at least one hand-operable latch opposite the hinge and configured for fixing the second housing portion to the first housing portion. The LED driver may be replaced by opening the housing by releasing the latch and disconnecting the LED driver from the connector, while the LED high bay remains installed or held to a structure, or portion thereof, with a support member.

13 Claims, 4 Drawing Sheets

(56) References Cited

U.S. PATENT DOCUMENTS

| | | | | |
|---|---|---|---|---|
| 11,181,253 | B2 * | 11/2021 | Kulkarni | F21V 21/30 |
| 2012/0212945 | A1 * | 8/2012 | Frank | F21V 29/773 362/184 |
| 2014/0268789 | A1 * | 9/2014 | Boyer | F21S 8/00 362/267 |
| 2016/0131356 | A1 * | 5/2016 | Engberg | F21V 14/02 362/373 |

* cited by examiner

LED HIGH BAY LAMP WITH TOOLLESS LED DRIVER CONNECTION

FIELD OF THE DISCLOSURE

This invention generally relates to LED high bay lamps and more specifically toward an LED high bay lamp configured for toolless LED driver replacement.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

LED lighting may be capable of high light output while consuming significantly less power than that consumed by traditional incandescent bulbs. A typical LED lighting system or lamp may include one or more LEDs and LED driver circuitry to power and the LEDs. LEDs require a regulated current supply and more complex LED driver electronics than traditional lighting.

LEDs typically have a longer useful life than the traditional incandescent bulbs. The life of the LEDs may be longer than the life of their LED driver. It may be desired to toollessly replace the LED driver in the lamp when the LEDs outlast their LED driver.

SUMMARY

In at least one embodiment of the present disclosure, an LED high bay lamp with a toolless replaceable LED driver is disclosed. The LED high bay lamp comprises a first housing portion having a lamp holder extending upward therefrom and a second housing portion. A hinge hingedly attaches a first side of the first housing portion to a first side of the second housing portion. The LED high bay lamp has at least one hand operable latch or catch configured and disposed for removably retaining a second side of the first housing portion to a second side of the second housing portion. The LED high bay lamp further comprises a replaceable LED driver removably held in the housing. A hand separable wire connector is disposed in all electrical lines leading to and from the toolless replaceable LED driver. An LED light source is disposed with the second housing portion. The LED high bay lamp is configured for the toolless replacement of the LED driver while the LED high bay lamp is held with the lamp holder.

In at least one other embodiment of the present disclosure, a method of toollessly replacing an LED driver in an LED high bay lamp, while the LED high bay lamp is held to a structure, or portion thereof, with a support member or lamp holder. The method comprises the steps of: unlatching or uncatching a second side of a first portion of a housing from a second side of a second portion of a housing; hingedly lowering the second portion of the housing from the first portion of the housing about one or more hinges, wherein the one or more hinges hold the first side of the first portion of the housing to the first side of the second portion of the housing; disconnecting at least one wire connector, by hand, and disconnecting all electrical lines leading to and from the LED driver being replaced; moving, by hand, the LED driver away from the second portion of the housing and removing the LED driver being replaced from the second portion of the housing; inserting, by hand, a replacement LED driver into the second portion of the housing and holding the replacement LED driver therein; connecting the at least one wire connector, by hand, and thereby connecting all electrical lines leading to and from the replacement LED driver; hingedly raising the second portion of the housing to the first portion of the housing about the one or more hinges; and latching or catching, by hand, the second side of the first portion of the housing to the second side of the second portion of the housing.

In at least one further embodiment, an LED high bay lamp with a toolless replaceable LED is disclosed. The LED high bay lamp has a replaceable LED driver removably held therewith and a hand separable wire connector in all electrical lines leading to and from the toolless replaceable LED driver. An LED light source is disposed on a lower surface of the LED high bay lamp. A support member or lamp holder is configured and disposed to hold the replaceable driver and the LED light source to a structure or portion thereof. The LED high bay lamp is configured for the toolless replacement of the LED driver while the LED high bay lamp is held with the support member or lamp holder. As used herein, the terms support member and lamp holder both mean a device or member configured and disposed to hold the replaceable driver and the LED light source to a structure or portion thereof, and thus may be used interchangeably.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope. The disclosure will be described with additional specificity and detail through use of the following figures, which are idealized, are not to scale, and are intended to be merely illustrative of aspects of the present disclosure and non-limiting. In the drawings, like elements may be depicted by like reference numerals. The drawings are briefly described as follows:

DETAILED DESCRIPTION

Figure 1:
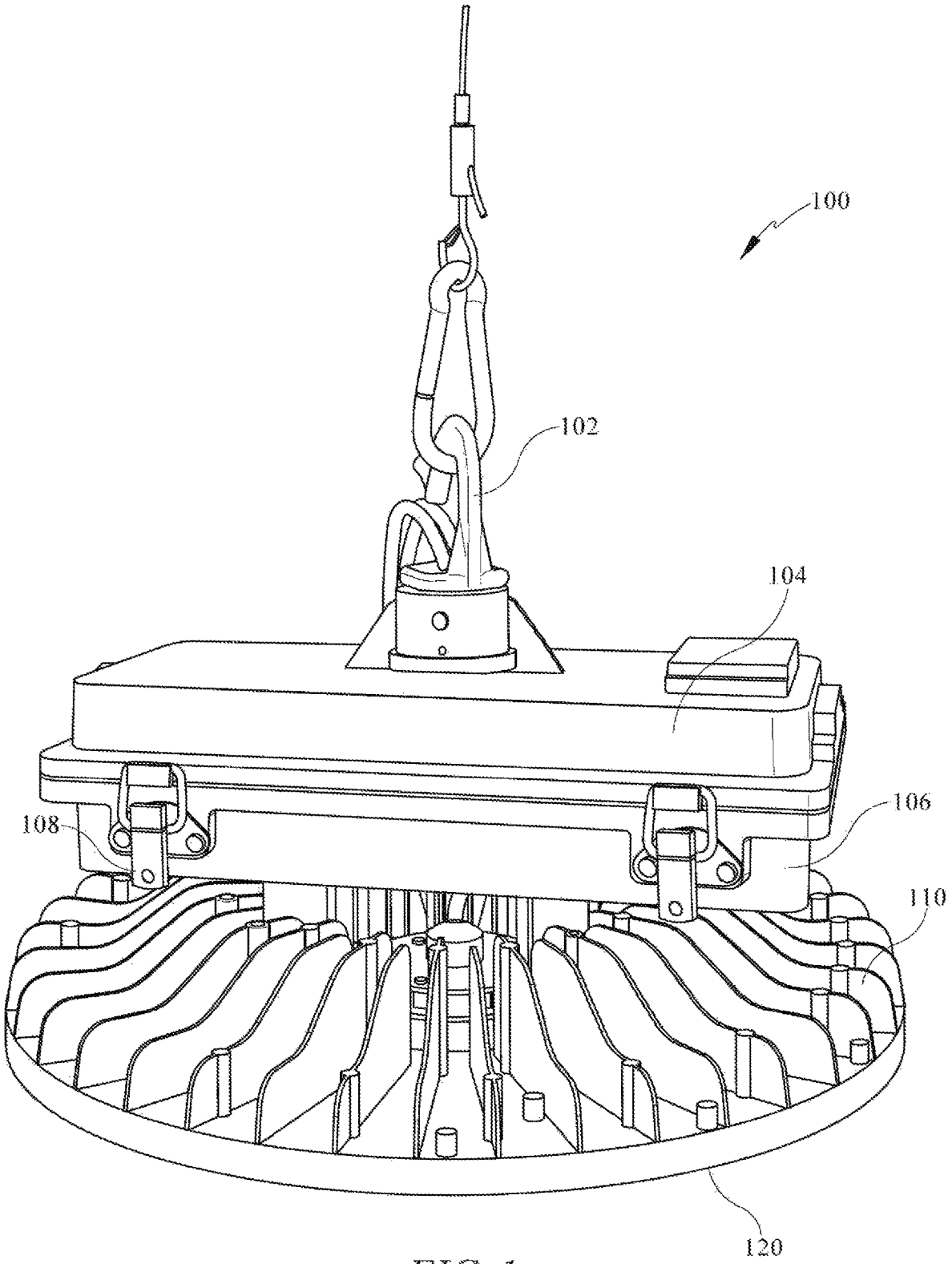
FIG. 1 shows a perspective view of an illustrative example of the LED high bay lamp with toolless LED driver replacement of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

In the LED lamp industry, the LED chips (light source) may have evolved to a higher efficiency and longer life than before. However, the LED driver which energizes the lamp is still evolving. Depending on the operating conditions, such as ambient temperature, the life of the LED driver can be short and fail early. When the LED driver fails, the whole lamp may need to be replaced, which may be costly.

Currently most, if not all, LED high bay lamps come with an LED driver which is built in the lamp. Repair or replacement of the LED lamp or driver may require that the lamp be taken down from the installation, repaired, and then the reinstallation of the lamp. This process may be exacerbated with high bay lamps as they are typically installed far from ground level and access to the high bay lamp may be problematic.

LEDs typically have a longer useful life than the traditional incandescent bulbs. The life of the LEDs may be longer than the life of their LED driver. It may be desired to toollessly replace the LED driver in the high bay lamp when the LEDs outlast the LED driver. For example, high bay lamps are typically installed far from ground level. In the event that the high bay lamp fails, it may be quite laborious to remove the high bay lamp for repair or replacement and may require more than one access to the installation.

Often, the LEDs outlast the LED driver in an LED high bay lamp. The present disclosure may provide for toolless removal and replacement of the LED driver in an LED high bay lamp with a single access to the installation. The toolless removal and replacement of the LED driver may provide reduced repair or labor costs associated with correcting malfunctions of the LED high bay lamp and may also avoid costs associated with obtaining a replacement lamp.

Figure 2:
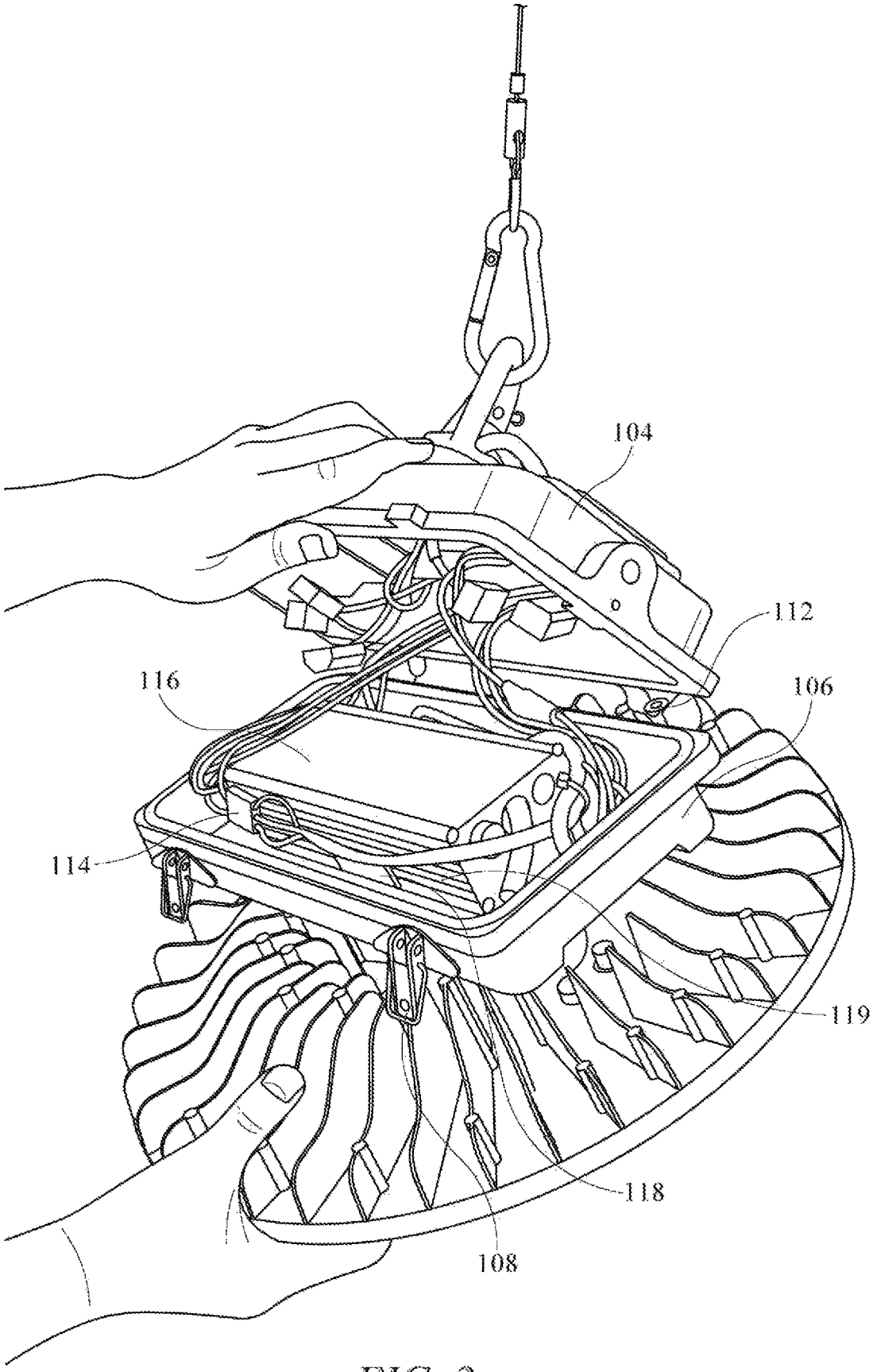
FIG. 2 shows the LED high bay lamp with toolless LED driver replacement of FIG. 1 having a second housing portion hingedly lowered from a first housing portion.

Presently disclosed is an LED high bay lamp, wherein the LED driver may be replaced without taking the lamp down from its installation and without tools. This may provide for a relatively quick and easy repair or replacement of the LED driver while standing on a ladder. Thus, only a single access to the high bay lamp, carrying only the replacement driver, ex. no tools, may be needed to replace the LED driver in the presently disclosed LED high bay lamp with toolless LED driver replacement FIGS. 1 and 2 show perspective views of an illustrative example of the presently disclosed LED high bay lamp 100 with toolless LED driver replacement. LED high bay lamp 100, with a toolless replaceable LED driver 116, has a housing with a first housing portion 104 and a second housing portion 106. A lamp holder 102 extends upward from first housing portion 104. A hinge 112 hingedly attaches a first side of first housing portion 104 to a first side of second housing portion 106. At least one hand operable latch or catch 108 is configured and disposed for removably retaining a second side of first housing portion 104 to a second side of second housing portion 106.

A replaceable LED driver 116 is removably held in the housing, between first housing portion 104 and second housing portion 106. A hand separable wire connector 114 is in all electrical lines leading to and from toolless replaceable LED driver 116. An LED light source 120 is disposed with second housing portion 106. LED high bay lamp 100 is configured for the toolless replacement of LED driver 116 while LED high bay lamp 100 is held with lamp holder 102, as shown in FIGS. 1-3.

LED high bay lamp 100 may have a retainer 118 configured and disposed for removably retaining LED driver 116 in second portion 106 of the housing. In at least one embodiment, retainer 118 has at least one springing arm configured and disposed to hold removable LED driver 116 with a frictional force between the springing arm and removable LED driver 116. Removable LED driver 116 and retainer 118, for example a springing arm retainer, may have non-planar surfaces configured and disposed to increase the frictional force between the springing arm and removable LED driver 116. For example, retainer 118 may have a ridge and LED driver 116 may have one or more troughs 119. Additionally, or alternatively, retainer 118 may have a fastener 121 configured for holding LED driver 116. For example, fastener 121 may be a wing nut or other hand operated fastener for toolless removal of LED driver 116 and installation of a replacement driver. In at least one embodiment, lower portion 106 is configured to hold LED driver 116 by gravity and/or its connected wires and may be void of a retainer 118.

FIG. 2 shows LED high bay lamp 100 with toolless LED driver 116 replacement having second housing portion 106 hingedly lowered from first housing portion 104. For example, latch(es) or catch(es) 108 may be released by hand and second housing portion 106 may be hingedly lowered from first housing portion 104, about hinge(s) 112. This may be performed while high bay LED lamp 100 is held to a structure, or portion thereof, with lamp holder 102.

Figure 3:
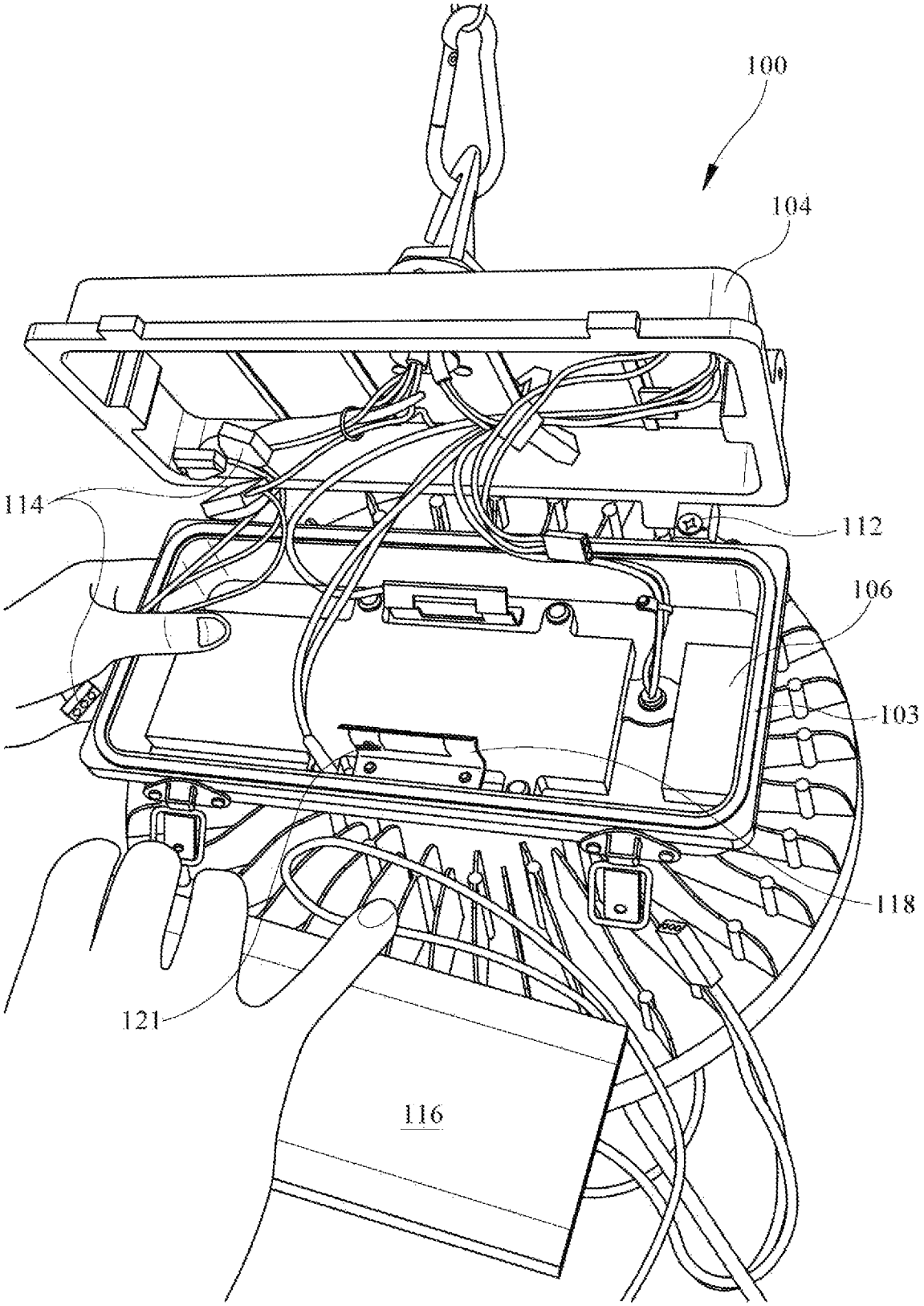
FIG. 3 shows the LED high bay lamp with toolless LED driver replacement of FIG. 1 having the LED driver toollessly removed from the housing.

FIG. 3 shows LED high bay lamp 100 having LED driver 116 toollessly removed from the housing. Toolless replacement of LED driver 116 may also be illustrated in FIG. 3 as upon the removal of LED driver 116, a replacement driver is simply installed in lower portion 106. For example, in the embodiment of LED high bay lamp 100 having a springing arm, LED driver 116 is simply moved, by hand, from lower portion 106 and a replacement driver is simply moved, by hand, into lower portion 106.

Figure 4:
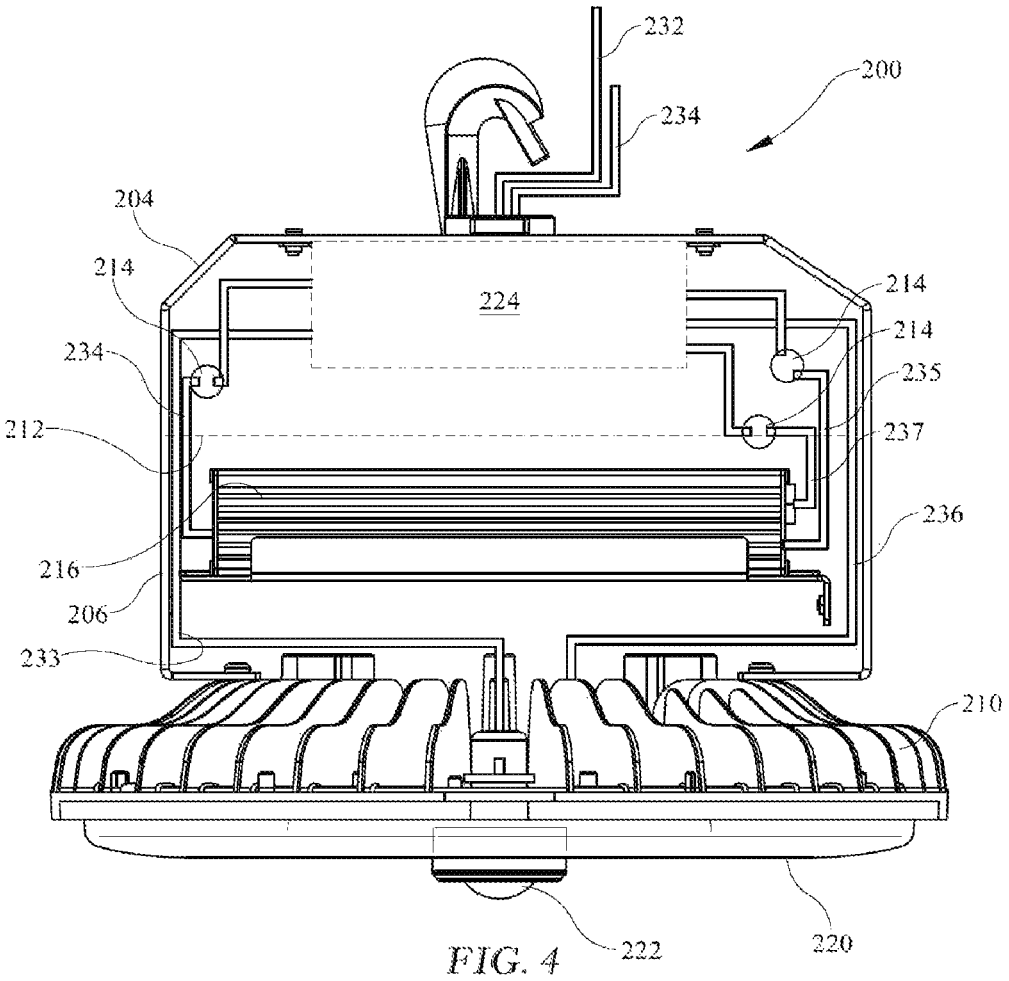
FIG. 4 shows an illustrative example of wiring and connectors that may be held in the housing of the presently disclosed LED high bay lamp with toolless LED driver replacement.

A seal 103 may be disposed between first portion 104 of the housing and second portion 106 of the housing. Seal 103 may be configured and disposed to provide a water tight seal between first portion 104 and second portion 106, upon latching or catching, with latches or catches 108, the second side of first housing portion 104 to the second side of second housing portion 106. A water tight seal between first portion 104 and second portion 106 may be desired to isolate removable driver 116, wiring, and junctions from environmental elements or even water from a sprinkler system. Seal 103 may be highly desired in high bay lamp applications as they may be installed in locations with higher exposure to the elements. In at least one embodiment, LED high bay lamp 100 is IP65 water resistant. For example, LED high bay lamp 100 may be protected against water jets from any angle as may be desired in industrial installations and/or in emergencies FIG. 4 shows an illustrative example of wiring and connectors that may be held in the housing of LED high bay lamp 200. For example, LED high bay lamp 200 may have a housing that serves as a junction box. Illustratively, LED high bay lamp 200 may be configured and disposed to house electrical junctions or the wires and connectors. For example, LED high bay lamp 200 may have a junction area 224. Junction area 224 may be an area, or volume, within the first portion 204 and the second portion 206 of the housing.

For example, the volume in the housing above removable driver 216 may be configured to house the electrical junctions or line connectors.

The wiring may comprise power 232, for example 100-277 V AC, and control line 234, for example 0-10V dimming leading into LED high bay lamp 200. Replaceable driver 216 may be an LED dimming driver. First portion 204 and second portion 206 may be hingedly joined about demarcation 212. The volume of the housing may be configured to house replaceable driver 216, AC line 234, photocell line 233, 0-10V line 237, driver DC line 235, LED line 236, all hand operable connectors 214, and junctions. All the lines leading to and from replaceable driver 216 may have a hand operable line connector 214. For example, AC line 234, 0-10V line 237, and driver DC line 235 may each have a connector 214.

Second portion 206 may hold an array of LEDs 220. Cooling fins 210 may be configured and disposed to dissipate heat from LEDs 220. One or more sensors 222 may also be held with LED high bay lamp 200. For example, LED high bay lamp 200 may have a photocell.

The presently disclosed LED high bay lamp may be designed to interface with existing lighting infrastructure, such as traditional dimmer switches. A number of different types of dimming exist, for example, button/switch dimming, phase-cut dimming, and 0-10 volt dimming. 0-10 volt dimming is often used in commercial lighting installations. It may be desired to wirelessly or remotely control the dimming of the presently disclosed LED high bay lamp, which may provide a desired user control of dimming and/or may reduce installation costs.

LED high bay lamp 200 may have a light dimming LED driver 216 which may be configured to be remotely controlled. For example, a correlated color temperature of the light output of the LED high bay lamp may be controlled. A light controller may have at least one sensor in electrical communication therewith. For example, the light controller may have at least one of a photocell and a PIR, passive infrared, sensor. The at least one sensor 222 may be held with LED high bay lamp 200 to provide a wide sensing angle or a large sensing area. For example, the at least one sensor may protrude from a lower portion of LED high bay lamp 200. LED high bay lamp 200 may have daylight harvesting functionality. Daylight harvesting functionality uses daylight to offset the amount of electric lighting needed to light a space to a desired level, in order to reduce energy consumption. LED high bay lamp 200 may be configured to dim or brighten its light source 220 in response to changing daylight availability, in response to the daylight sensed with sensor(s) 222.

LED high bay lamp 200 may be configured for wireless light control and may be in cooperation with a variety of wireless receivers and/or sensor(s). For example, LED high bay lamp 200 may be configured to receive one or more of Bluetooth, WiFi, Zigbee, Z-Wave, 6LoWPAN, IR, and cellular signals. This may configure LED high bay lamp 200 to be remotely controlled, for example, dimming and other functions of LED high bay lamp 200 may be performed with a variety of remote electronic devices. Mobile electronic devices such as phones, tablets, and remotes may be configured to wirelessly send signals to a receiver in communication with LED high bay lamp 200 and control the dimming, the color temperature, on/off status, and other parameters of LED high bay lamp 200.

LED high bay lamp 200 may be in communication with a variety of light sensors. For example, one or more of a photocell, PIR, microwave, ultrasonic, optical, and other light sensors as are known in the art may be in communication with LED high bay lamp 200

A method of toollessly replacing an LED driver in an LED high bay lamp while the LED high bay lamp is held to a structure, or portion thereof, with a lamp holder, is presently disclosed. The method may comprise unlatching or uncatching a second side of a first portion of a housing from a second side of a second portion of a housing and hingedly lowering the second portion of the housing from the first portion of the housing about one or more hinges. The one or more hinges hold the first side of the first portion of the housing to the first side of the second portion of the housing. At least one wire connector is disconnected, by hand, and all of the electrical lines leading to and from the LED driver being replaced are disconnected. The LED driver is moved away from the second portion of the housing and is thereby removed from the second portion of the housing by hand. A replacement LED driver is placed into the second portion of the housing and is held therein. The at least one wire connector is connected, by hand, and all electrical lines leading to and from the replacement LED driver are connected. The second portion of the housing is hingedly raised to the first portion of the housing about the one or more hinges. The second side of the first portion of the housing is latched, caught, or otherwise secured, by hand, to the second side of the second portion of the housing.

The step of moving, by hand, the LED driver away from the second portion of the housing may comprise overcoming a frictional force holding the removable LED driver in the second portion. The first housing portion may be sealed with the second housing portion, upon the latching or catching the second side of the first housing portion to the second side of the second housing portion. The step of connecting the at least one wire connector, by hand, may comprise connecting at least two wire connectors. For example, with quick connects. Each of the wire connectors and wire junctions may be housed between the first and second portions of the housing.

The presently disclosed LED high bay lamp may have a light dimming LED driver which may be configured to remotely control a correlated color temperature of the light output of the LED high bay lamp. LED high bay lamp 200 may have a wireless light controller and may have one or more sensors in communication therewith. For example, the light controller may have at least one of a photocell and a PIR, passive infrared, sensor. The at least one sensor may be held with LED high bay lamp 200 to provide a wide sensing angle or a large sensing area. For example, the at least one sensor 222 may protrude from a lower portion of LED high bay lamp 200. For example, a wireless light controller may configure LED high bay lamp 200 to have daylight harvesting functionality. Daylight harvesting functionality uses daylight to offset the amount of electric lighting needed to light a space to a desired level, in order to reduce energy consumption. LED high bay lamp 200 may be configured to dim or brighten its light source 220 in response to changing daylight availability, in response to the daylight sensed with sensor(s) 222.

LED high bay lamp 200 may be in communication with a variety of light sensors. For example, one or more of a photocell, PIR, microwave, ultrasonic, optical, and other light sensors as are known in the art may be in communication with LED high bay lamp 200

The presently disclosed high bay lamp is configured to be installed at a distance from the area to be illuminated. For example, the LED high bay lamp of the present disclosure may be configured to be installed at a height of about ten to twelve feet, or less, about twelve to fifteen feet, or more, in fractions of an inch, above a floor and provide a desired illumination of the area below.

It is to be understood that the presently disclosed LED high bay lamp 200 may have a variety of configurations and may be configured for mounting to a structure, or portion thereof. For example, LED high bay lamp 200 may be configured to be attached to, or hung from, a ceiling.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. An LED high bay lamp comprising:

a first housing portion;

a second housing portion configured to be coupled to the first housing portion;

an LED driver removably held with the LED high bay lamp;

an LED light source disposed on a surface of the LED high bay lamp;

a support member extending from a surface of the LED high bay lamp opposite the LED light source, the support member being configured and disposed to support the replaceable driver and the LED light source from a structure or portion thereof;

at least one hand removable connector electrically coupling the LED driver to the LED light source and an external power source; and a seal disposed between the first housing portion and the second housing portion, the seal being configured to provide a water tight seal therebetween and to isolate the driver, wiring, and junctions from environmental elements and water from a sprinkler system, upon coupling of the first housing portion to the second housing portion, wherein the LED high bay lamp is configured for the toolless replacement of the LED driver while the LED high bay lamp is supported from the structure, or portion thereof, by the support member.

2. An LED high bay lamp comprising:

a first housing portion having a support member extending from one end therefrom, the support member being configured and disposed to hold the LED high bay lamp to a structure or portion thereof;

a second housing portion provided on an end of the first housing portion opposite the support member;

a hinge hingedly attaching a first side of the first housing portion to a first side of the second housing portion;

at least one hand operable latch or catch configured and disposed for removably retaining a second side of the first housing portion to a second side of the second housing portion, such that the first and second housing portions form a housing;

an LED driver removably held in the second housing portion;

an LED light source disposed with the second housing portion;

at least one hand removable connector electrically connecting the LED driver to the LED light source and an external power source; and a seal disposed between the first housing portion and the second housing portion, the seal being configured to provide a water tight seal therebetween and to isolate the driver, wiring, and junctions from environmental elements and water from a sprinkler system, upon latching or catching the second side of the first housing portion to the second side of the second housing portion, wherein the LED high bay lamp is configured for the toolless replacement of the LED driver while the LED high bay lamp is held to the structure or portion thereof, with the support member.

3. The LED high bay lamp of claim 2, wherein the LED light source comprises an array of LEDs.

4. The LED high bay lamp of claim 2 further comprising at least one sensor.

5. The LED high bay lamp of claim 2, wherein the LED driver is a 0-10V dimming LED driver.

6. The LED high bay lamp of claim 2, comprising a retainer configured and disposed for removably retaining the LED driver in the second portion of the housing.

7. The LED high bay lamp of claim 6, wherein the retainer comprises at least one springing arm configured and disposed to hold the removable LED driver with a frictional force between the springing arm and the removable LED driver.

8. The LED high bay lamp of claim 7, wherein the removable LED driver and the springing arm have non-planar surfaces configured and disposed to increase the frictional force between the springing arm and the removable LED driver.

9. A method of toollessly replacing an LED driver in an LED high bay lamp while the LED high bay lamp is held to a structure, or portion thereof, with a support member, the method comprising the steps of:

unlatching or uncatching a second side of a first housing portion from a second side of a second housing portion;

hingedly lowering the second housing portion, and a light source disposed therewith, from the first housing portion about one or more hinges, wherein the one or more hinges hold the first side of the first housing portion to the first side of the second housing portion;

disconnecting at least one wire connector, by hand, and disconnecting all electrical lines leading to and from the LED driver being replaced;

moving, by hand, the LED driver away from the second housing portion and removing the LED driver being replaced from the second housing portion;

inserting, by hand, a replacement LED driver into the second housing portion and holding the replacement LED driver therein;

connecting the at least one wire connector, by hand, and thereby connecting all electrical lines leading to and from the replacement LED driver;

hingedly raising the second housing portion to the first housing portion about the one or more hinges; and latching or catching, by hand, the second side of the first housing portion to the second side of the second housing portion and sealing the first housing portion to the second housing portion and providing a water tight seal therebetween and isolating the replacement LED driver, wiring, and junctions from environmental elements and water from a sprinkler system.

10. The method of toollessly replacing an LED driver in an LED high bay lamp of claim 9, wherein the step of connecting the at least one wire connector, by hand, comprises connecting at least two wire connectors.

11. The method of toollessly replacing an LED driver in an LED high bay lamp of claim 9 comprising housing each of the wire connectors and wire junctions between the first and second portions of the housing.

12. The method of toollessly replacing an LED driver in an LED high bay lamp of claim 9, wherein the step of moving, by hand, the LED driver away from the second housing portion comprises overcoming a frictional force holding the removable LED driver in the second housing portion.

13. The method of toollessly replacing an LED driver in an LED high bay lamp of claim 9 comprising sealing the first housing portion with the second housing portion, upon the latching or catching the second side of the first housing portion to the second side of the second housing portion.

* * * * *